United States Patent [19]

Bordner

[11] Patent Number: 5,046,632

[45] Date of Patent: Sep. 10, 1991

[54] CLOSURE ASSEMBLY FOR FIBER CONTAINER INCLUDING A MOLDED LID WITH MULTI-MODE CLOSURE ORIENTATIONS

[76] Inventor: Paul G. Bordner, 7803 Fairlawn Dr., Pickerington, Ohio 43147

[21] Appl. No.: 483,353

[22] Filed: Feb. 22, 1990

[51] Int. Cl.[5] ..... B65D 17/40

[52] U.S. Cl. ..... 220/276; 220/270; 220/306; 220/308; 220/380; 206/503; 215/254

[58] Field of Search ..... 220/270, 276, 306, 308; 215/254

[56] References Cited

U.S. PATENT DOCUMENTS

| | | | |
|---|---|---|---|
| 3,811,597 | 5/1974 | Frankenberg et al. | 220/306 X |
| 3,814,278 | 6/1974 | Beierle | 220/308 |
| 3,942,679 | 3/1976 | Starr | 220/306 X |
| 4,037,748 | 7/1977 | Stubbs, Jr. | 220/306 X |
| 4,660,735 | 4/1987 | Pescherdt et al. | 220/276 |

*Primary Examiner*—Stephen Marcus
*Assistant Examiner*—Nova Stucker
*Attorney, Agent, or Firm*—Mueller and Smith

[57] ABSTRACT

A closure assembly for use with fiber containers of a generally cylindrical shape which includes an integrally molded lid having a top portion which extends to a periphery which incorporates a seating channel and a skirt assembly within which primary and secondary latching components are retained. The lid is associated for multi-mode closure upon the container through the use of a plurality of spaced fasteners which are attached to the container outer sidewall in a predetermined spaced relationship adjacent the top edge thereof. Primary latching components within the skirt assembly are of limited extent and are removable from the lid through the use of a pull tab and parting groove architecture. Thus, the lid may be removably secured to the container with the secondary latching feature within the upper portion of the skirt assembly without damaging and without engaging the primary latching structure for pre-filling shipment. Following filling of the container, the lid may be attached thereto in a filled mode wherein the primary latching feature is engaged by proper orientation of the lid. The end user removes the primary latching feature in tear-away fashion and the secondary latching feature remaining in the skirt assembly permits reclosure mode utilization by the end user.

33 Claims, 5 Drawing Sheets

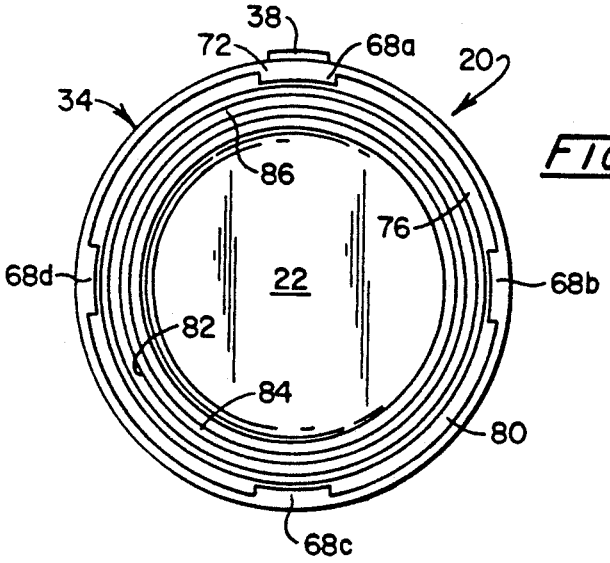
FIG. 7
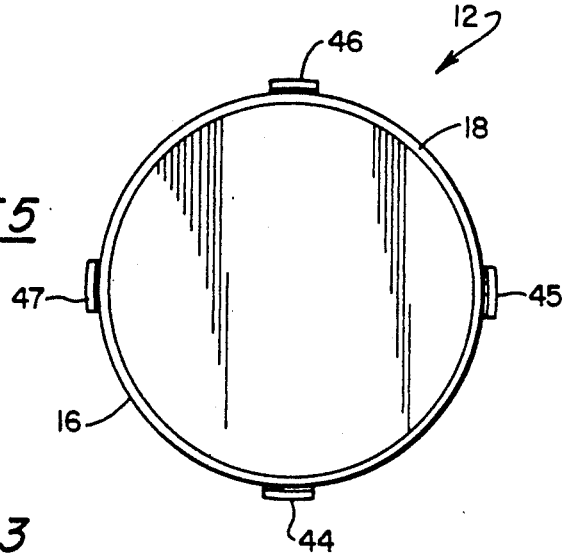
FIG. 5
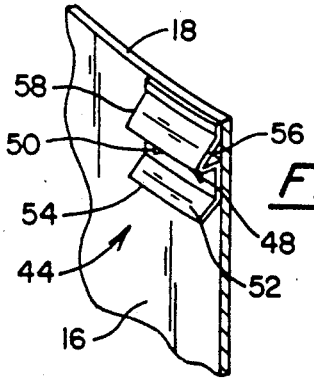
FIG. 3
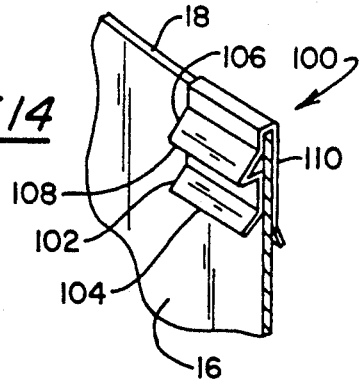
FIG. 14
FIG. 4
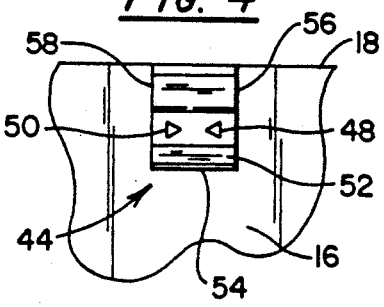
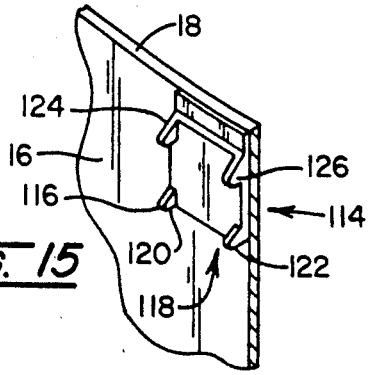
FIG. 15

CLOSURE ASSEMBLY FOR FIBER CONTAINER INCLUDING A MOLDED LID WITH MULTI-MODE CLOSURE ORIENTATIONS

BACKGROUND OF THE INVENTION

Cellulosic or fiber containers have long been employed by industry for the purpose of packaging and transporting a broad variety of substances which are considered generally to be non-caustic. Such materials include, for example, a variety of foods, soaps, fertilizers and the like. For many such materials, important packaging cost savings may be realized by resort to these fiber containers as compared with plastic or steel containers or the like of equivalent capacity. Typically, the fiber containers are shaped as right cylinders having diameters from about 8 to 18 inches which are closed by metal or fiber lids secured, in turn, conventionally by two or more clips which are cleated to the container body portion. Generally, reliable lid securement is not available to the end user following initial opening of the containers. Consequently, where the material within such container is accessed on a somewhat repetitive basis by the user, no desirably secure and practical reclosure of the container is available. Such secondary closure features are found to be valuable not only on the part of the end user but also prior to filling containers, i.e. during their pre-filling mode of use where the assemblages of container and lid are shipped as a unit to the filling party. For such shipment purposes, it also is desirable to provide a container-lid architecture wherein the lid is removably securable to the container such that it can be removed for container filling, then repositioned and locked into place. Preferably, this latter attachment of locking of the lid by the filling entity is provided by a "tamper evident" technique where any subsequent opening involves a readily apparent destruction of the primary latching structure.

Stacking considerations also are encountered in connection with the shipping or transporting of lids themselves to the filling or container manufacturing entity. Thus, their design, while incorporating the above multiple mode latching aspects, should also permit a compact and convenient stacking capability. Finally, to permit economical, higher volume production, the lid should be fabricable of a plastic material such as a polyolefin using practical molding techniques.

SUMMARY

The present invention is addressed to a closure assembly for containers, particularly those formed of a cellulosic or fiber material wherein a molded plastic lid is provided having both primary and secondary latching or retention features. These latching features are structured to cooperate with discrete fastener components which are attached to the external surfaces of the container in a predetermined spaced-apart relationship. Correspondingly, the primary latching feature of the lid is structured having spaced-apart regions for engagement with the fasteners such that locking retention of the lid is developed by selectively orienting a lid with respect to the container. However, for all such orientations, the releasable, secondary latching feature remains effective. Thus, the closure assembly provides desired latching performance in a pre-fill mode for delivery to a filling entity wherein only the secondary or removable latching feature is invoked. Further, the assemblage provides for a filled mode of closure wherein both secondary and primary latching is achieved. This latter primary latching is of a tamper evident variety which is permanent to the extent that a portion of the skirt assembly of the lid must be removed along a parting line to release the latch. Finally, following opening by the end user, the second latching feature again is employed in the absence of the permanent primary latch to provide a reclosure mode without orientation requirements.

Another particular feature of the invention is to provide a closure assembly for a container of a variety having a sidewall with internal and external surfaces extending from a bottom rim to a top portion having a top edge. The assembly includes a discrete fastener arrangement connected in predetermined spaced-apart relationship with the sidewall, extending downwardly along the external surface thereof substantially from the top edge. The fastener arrangement includes a primary detent and a secondary detent, each extending outwardly from the external surface of the container. A molded lid is provided for closure over the container which includes a lid top portion formed of resilient plastic material extensible across the container top portion to an outer periphery locatable adjacent the container top edge. A skirt assembly is integrally formed with the lid top portion and extends downwardly from the periphery of the lid top portion to a lower edge locatable below the primary detent. The skirt assembly includes a parting groove extending thereabout to define upper and lower skirt portions and a hand graspable portion configured with the skirt lower portion for effecting the manual removal of the skirt lower portion from along the parting groove. A primary latching ledge is formed within discrete, spaced-apart regions of the skirt assembly lower skirt portion in correspondence with the predetermined spaced-apart relationship of the fasteners for non-releasing engagement with the primary detent when the lid is rotationally oriented for engaging contact therewith. A secondary latching detent is formed substantially continuously within the skirt assembly upper skirt portion for removable latching engagement with the fasteners secondary detent in substantially all rotational orientations of the lid upon the container and a sealing channel is formed within the lid top portion outer periphery for abutting container closure engagement against the container top edge.

Another particular feature of the invention is concerned with a closure assembly for a cellulosic container of a variety having a cylindrical sidewall with internal and external surfaces extending from a bottom rim to a top portion having a top edge. The assemblage includes a plurality of discrete fasteners connected to the container adjacent the top edge and located about the external surface thereof in a predetermined spaced-apart relationship. The fasteners include a primary detent component and a secondary detent component spaced thereabove. A molded lid is provided which is orientable for closure over the container in a pre-fill mode, a filled mode, and a reclosure mode. The lid includes a discoidal lid top portion formed of resilient plastic material and extensible across the container top portion to an outer periphery locatable adjacent the container top edge. A skirt assembly is integrally formed with the lid top portion and extends downwardly from the periphery thereof to a lower edge locatable below the primary detent component. The skirt assembly includes a parting locus for defining upper and lower skirt portions and a hand graspable arrangement configured with the skirt lower portion for effecting the removal of the skirt lower portion. A plurality of primary latching components are formed within discrete, spaced-apart regions of the skirt assembly lower skirt portion in geometric correspondence with the predetermined spaced-apart relationship of the fastener, the primary latching components being nonengaged with the primary detent components of the fasteners when the lid is oriented for the pre-fill mode, being engaged with the primary detent component when the lid is oriented for the fill mode and disengageable therefrom substantially only by the removal of the lower skirt portion to permit use of the lid in the reclosure mode. A secondary latching detent arrangement is formed substantially continuously within the skirt assembly upper skirt portion for removable latching engagement with the secondary detent component of the fasteners when the lid is oriented in the pre-fill, filled and reclosure mode.

Another particular feature of the invention is to provide a lid for multi-mode closure over a cellulosic container of a variety having a sidewall with internal and external surfaces extending from a bottom rim to a top portion having a top edge and wherein a plurality of discrete fasteners are connected to the container adjacent the top edge and located about the external surface of the container in a predetermined, spaced-apart relationship and which fastener includes a primary retaining component and a secondary detent component spaced above the primary retaining component. The lid includes a discoidal lid top portion formed of resilient plastic material and extensible across the container top portion to an outer periphery locatable adjacent the top edge of the container. A skirt assembly is integrally formed with the lid top portion and extends downwardly therefrom to a lower edge. This skirt assembly further includes a parting groove extending thereabout to define upper and lower skirt portions and has a hand-graspable arrangement configured with the skirt lower portion for facilitating the removal of the skirt lower portion. A plurality of primary latching ledges are formed within discrete, spaced-apart regions of the skirt assembly lower skirt portion in correspondence with the predetermined spaced-apart relationship of the fasteners and depending inwardly from the skirt assembly lower edge. These primary latching ledges are nonengaged with the primary retaining component of each fastener when the lid is oriented for a pre-fill mode, being engaged with the primary retaining component of each fastener when the lid is oriented for a filled mode and is disengageable therefrom substantially only by the removal of the lower skirt portion. A secondary latching detent arrangement is formed substantially continuously within the skirt assembly upper skirt portion for removable latching engagement with the secondary detent component of the fasteners when the lid is oriented in the noted prefill and filled modes and in a reclosure mode occurring subsequent to removal of the lower skirt portion.

Other objects and features of the invention will, in part, be obvious and will, in part, appear hereinafter.

The invention, accordingly, comprises the apparatus possessing the construction, combination of elements, and arrangement of parts which are exemplified in the following detailed disclosure. For a fuller understanding of the nature and objects of the invention, reference should be had to the following detailed description taken in connection with the accompanying drawings.

BRIEF DESCRIPTION OF THE DRAWINGS

FIG. 3 is a partial perspective view showing a fastener component employed with the closure assembly of FIGS. 1 and 2;

FIG. 4 is a front view of the fastener of FIG. 3;

FIG. 5 is a top view of the container of FIG. 1 without the lid attached thereto;

FIG. 7 is a bottom view of the lid illustrated in FIGS. 1, 2, and 6;

FIG. 14 is a perspective view showing another embodiment of a fastener which may be employed with the closure assembly of the invention;

FIG. 15 is a perspective view of still another fastener which may be employed with the closure assembly of the invention;

DETAILED DESCRIPTION OF THE INVENTION

In the discourse to follow, the closure assembly of the invention initially is described as it is employed in a filled mode of utilization wherein the container has been filled with a given material and the lid has been affixed to it in a secure manner. In the latter regard, the lid is not practically removable without the removal of a tear-away portion of it containing primary latching components. This mode also provides a tamper evident feature. The discussion then turns to the employment of the assemblage in a pre-fill mode wherein the container manufacturer applies the lid to the empty container for shipment in a manner such that the secondary latching feature retains the lid and the primary latching feature is reserved for use in the above-noted fill mode. Finally, the assemblage is described in conjunction with employment by the end user in a reclosure mode wherein the primary latching feature has been removed and a secondary latching feature permits removable closure of the lid over the container.

Figure 1:
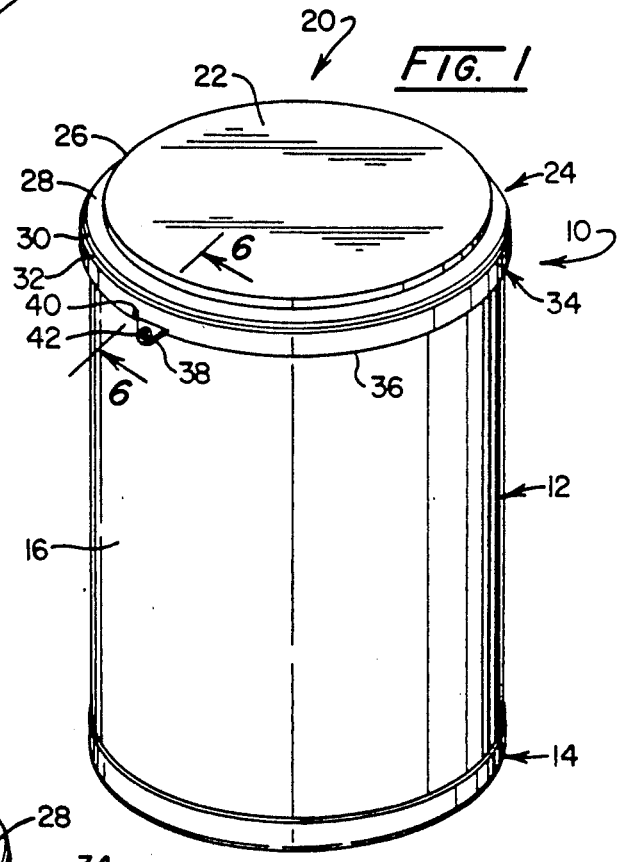
FIG. 1 is a perspective view of a container and lid assemblage according to the invention.
Figure 2:
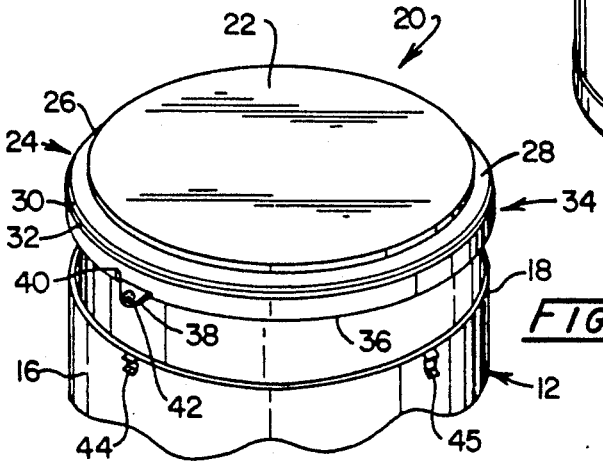
FIG. 2 is a partial perspective view of the container of FIG. 1 showing the lid enclosure assembly components in spaced-away and oriented fashion.

Looking to FIG. 1, a closure assembly of the invention is revealed generally at 10. The assemblage 10 includes a right cylindrical container 12 fashioned of a fiber or cellulosic material such as cardboard or the like. The container 12 includes a bottom rim structure represented generally at 14 and a sidewall of cylindrical configuration at 16 which extends to a top edge shown in FIG. 2 at 18. Attached to the top edge of container 12 is a molded lid represented generally at 20. Lid 20 preferably is formed, for example, as an integrally molded polyolefin form of plastic and in the filled mode shown can only be removed from container 12 by tearing away a primary latching component. Lid 20 is seen to include a discoidal shaped lid top portion 22 which extends across the top of the container 12 to an outer periphery represented generally at 24 which is locatable or positionable adjacent the top edge 18 of container 12 as seen in FIG. 2. The region of the outer periphery 24 also includes a centering ridge 26 which facilitates stacking, the bottom rim structure 14 of a stacking container being positionable upon a container stacking surface 28 seen generally horizontally disposed and next adjacent to ridge 26. Surface 28 extends outwardly, in turn, to a lid centering ridge which is employed for stacking of lids without a container as at 12 in conjunction with a generally horizontally upwardly disposed lid seating surface 32. A skirt assembly represented generally at 34 is integrally formed with the lid top portion 22 and extends downwardly from the periphery 24 to a lower edge 36. A primary latching arrangement is removable from the lid 20 by removing a lower portion of skirt 36. This removal is facilitated by a hand-graspable tab 38 seen adjacent a slot 40 in skirt assembly 24. Grasping of the pull tab 38 is improved by the roughened surface of a small circular adhesively attached gripper pad 42 fashioned of sandpaper or the like. Where provided having a readily perceptible color, the pad 42 also serves as a lid orienting or indexing indicia to aid the user in proper placement.

Tab 38 serves an additional function of orienting the lid 20 for the mode of attachment at hand. In FIGS. 1 and 2, the tab is shown orienting the lid 22 for engagement of the primary and secondary locking features. In the latter regard, FIG. 2 shows two of a plurality of discrete fasteners as at 44 and 45 which are connected to the container sidewall 16 adjacent to top edge 18. For the instant filled mode of utilization of the assemblage, FIG. 2 reveals that the pull tab 38 is aligned with a given fastener as at 44.

Turning to FIGS. 3 and 4, the particular embodiment for fastener 44 is revealed at an enhanced level of detail. The embodiment for the fastener of FIG. 3 is of stamped sheet metal which is attached to the sidewall 16 by a cleat configuration as at 48 and 50 (see FIG. 4). Other modes of attachment will be apparent, i.e. riveting adhesives and the like. Fastener 44 is seen to include a primary detent 52 extending downwardly and outwardly and having an outer contact edge 54. A secondary detent 56 also is formed within fastener 44 and is seen to include the rounded contact edge 58 which functions to promote the re-engaging feature of the secondary latch arrangement of the assembly 10.

Looking momentarily to FIG. 5, it may be observed that fasteners 44 and 45 are spaced at 90° intervals along the top edge 18 of container 12 and the fastening arrangement additionally includes similarly spaced fasteners 46 and 47 for a total of four such devices. The number of fasteners as at 44–47 will vary depending upon the strengthening requirements of the lid and container assembly. However, it may be observed that the fasteners 44–47 are connected to the other surface of container wall 16 in a predetermined, spaced-apart relationship.

Figure 6:
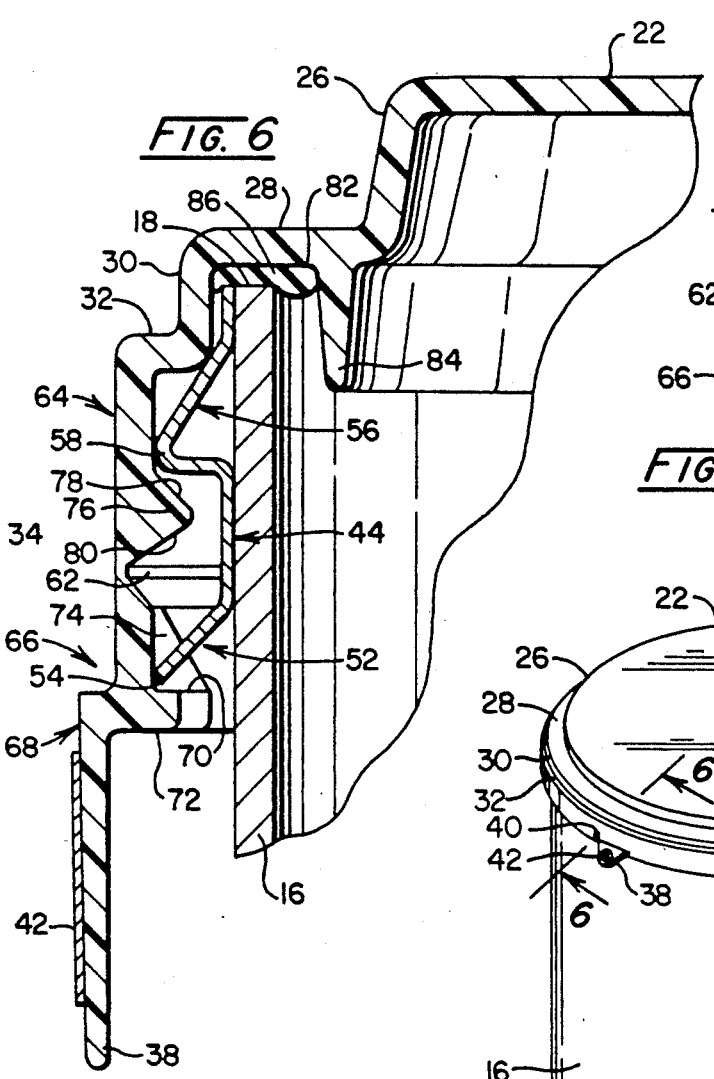
FIG. 6 is a partial sectional view taken through the plane 6—6 shown in FIG. 1.

Looking to FIGS. 2 and 6, where the lid 20 is oriented as shown in FIG. 2 and then secured to container 12, both the primary and secondary latching features of the assemblage become effective. FIG. 6 shows that the skirt assembly 34 is configured such that its interior or inwardly-directed surface is formed having a parting groove 62 which extends continuously thereabout to define an upper skirt portion 64 and a lower skirt portion 66. Extending inwardly from the lower edge 36 and within lower skirt portion 66 is a primary latching ledge or component represented generally at 68 and which is formed having an inwardly-depending retainer surface 70 which extends substantially perpendicularly from the internally disposed surface of skirt lower portion 66. Note that the retainer surface 70 engages the outer contact edge 54 of primary detent 52. This engagement is such that the edge 54 may, in effect, embed itself within surface 70 should upward stress be placed upon lid 20. In effect, the lid 20 cannot be removed from container 12 when this primary latching arrangement is engaged. Only by removing the lower skirt assembly by grasping the pull tab 38 and tearing it from the lid assembly 20 via parting groove 62 is the primary latch arrangement released. Disposed oppositely from retainer surface 70 is a downwardly disposed lid stacking surface 72.

Figure 6A:
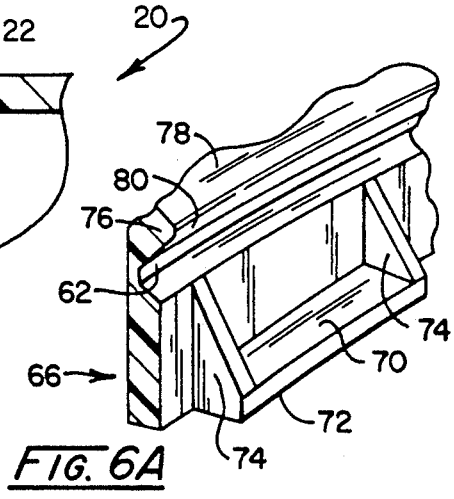
FIG. 6A is a partial perspective view of the retainer surface and limit stops of the lid components shown in FIG. 6.

Each of the primary latching ledges are of limited lengthwise or circumferential extent within the lower portion 66 of skirt assembly 34. Their relative positioning is provided in correspondence with the noted positioning of fasteners 44–47 (FIG. 5). Thus, the multimode utilization of the container assembly is achieved. Looking to FIG. 7, a bottom view of lid 20 is revealed showing four regularly spaced primary latching ledge components as at **68*a*–68*d*. The lengthwise extent of each of these ledges 68*a*–68*d* is selected to permit facile alignment of the lid 20 without undue resort to indexing procedures and the like, the tab 38 being sufficient to apprise the user of proper alignment following filling. While the engagement of edge 54 of primary detent 52 with the retainer surface 70 functions to maintain the lid from rotational movement during shipping and the like, limit stops additionally are included in the structure, one such stop being represented at 74 in FIG. 6. Stops as a 74 and their association with ledge 68 retainer surfaces 70 are revealed at an enhanced level of detail in FIG. 6A**.

FIG. 6 also reveals the engagement of the rounded contact edge 58 of fastener secondary detent 56 with a secondary latching detent 76 formed within the skirt assembly 34 upper portion 64. Note that detent 76 is positioned just above parting groove 62 and includes an outwardly and downwardly sloping contact surface 78 as well as an upwardly slanting surface 80. Thus, surface 78 is in abuttable contact with surface 58 to provide for secondary retention of the lid 20 and this feature, with the removal of the primary latching feature, permits reclosure of the lid 20 upon container 12 following first removal of the lid with removal of the primary latching components. Preferably, the secondary latching detent 76 is continuous about the upper portion 64 of skirt assembly 34.

FIG. 6 additionally reveals the presence of a sealing channel 82 formed within the lid top portion of the periphery 24 which provides sealing closure by virtue of its abutting engagement against the container top edge 18. The channel 82 is additionally defined by an annular supporting rib 84. Rib 84 provides a strengthening of the lid with respect to laterally imposed forces which might otherwise cause cave-in phenomena or the like and, additionally, aids in manually centering the lid 20 upon container 12. A gasket 86 is located within the channel 82 to enhance sealing. Gasket 86 may be provided, for example, as a hot melt gasket marketed by Dewey and Almy Co., Lexington, Mass., as a type 415 or 415A.

Figure 10:
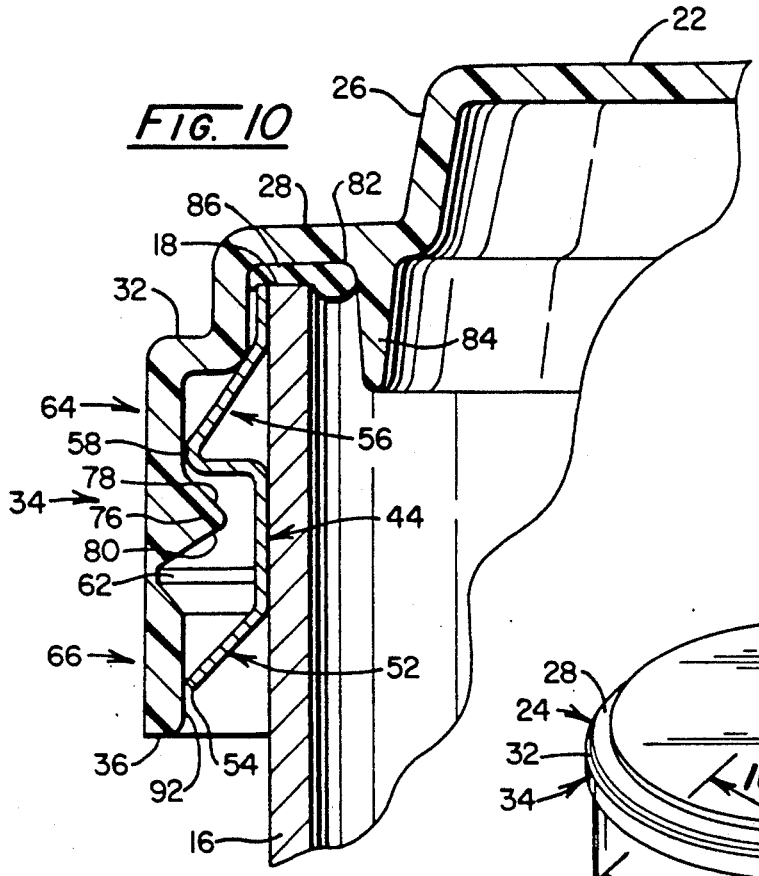
FIG. 10 is a partial sectional view taken through the plane 10—10 shown in FIG. 8.
Figure 8:
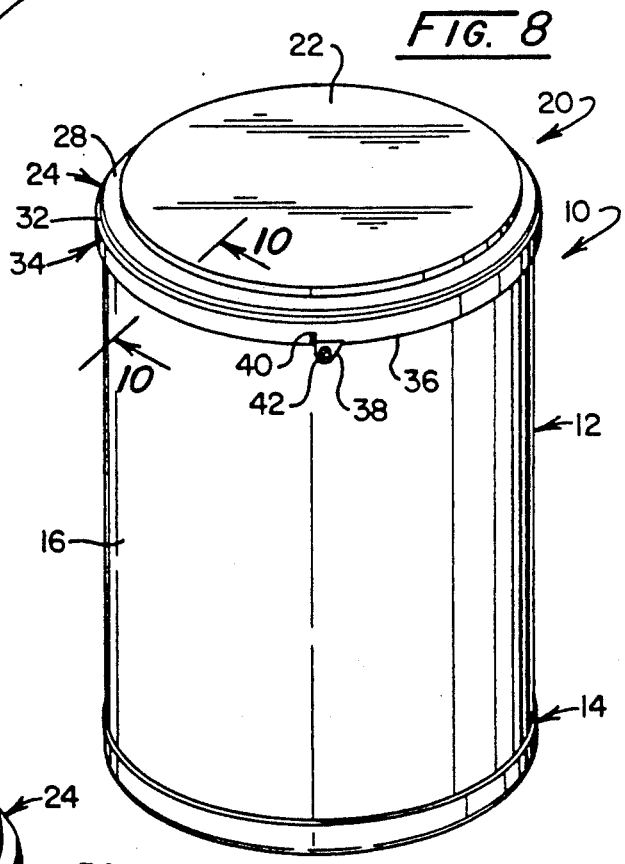
FIG. 8 is a perspective view of a container and lid assembly according to the invention showing the lid oriented in a pre-fill mode.
Figure 9:
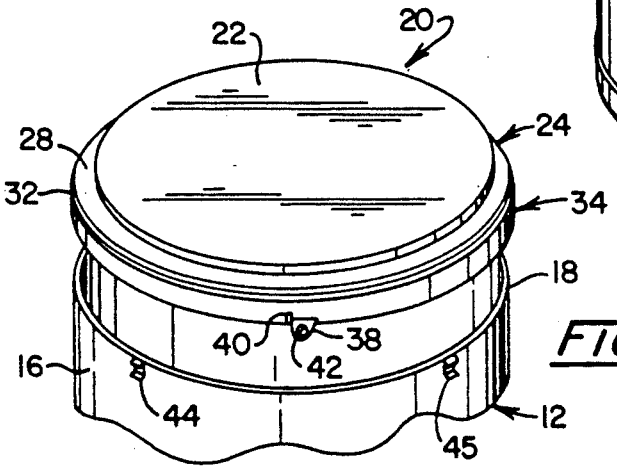
FIG. 9 is a partial perspective view of the lid and container assembly of FIG. 8 showing the lid elevated above the top of the container.

Turning to FIG. 8, the closure assembly 10 is represented in the pre-fill mode wherein the secondary latching features retain lid 20 in position upon container 12 and the primary latching features are disengaged but still intact. In the figure, it may be observed that the pull tab 38 has been maneuvered as a lid positioning indexing procedure in a counter-clockwise direction by about 45° as compared with the orientation thereof shown in FIG. 1. Looking to FIG. 9, it may be observed that the pull tab 38 now is located intermediate fasteners 44 and 45. With this orientation the primary latching ledges 68 as described in connection with FIG. 7 as at 68*a*–68*d* are oriented such that no engagement is made with the contact surface 54 of primary detent 52 of each of the fasteners 44–47 (FIG. 5). Now, the continuous secondary latching detent 76 provides for a temporary or recloseable placement of the lid 22 upon container 12. Looking to FIG. 10, the orientations of the primary and secondary latching features for this orientation or pre-fill mode are revealed. In the figure, it may be observed that contact surface 54 of fastener primary detent 52 is not engaged with the primary detent ledge and is in slidable abutting contact with the interior surface 92 of skirt assembly 34 lower skirt portion 66. However, the lid 22 is retained in position upon the container 12 by virtue of the engagement of rounded contact surface of secondary detent 66 of fastener 44. In this regard, the surface 58 is arranged in abuttable contact with the lid contact surface 78 of secondary latching detent 76. Thus, the lid may be removably attached for shipment to a station or entity for carrying out filling and subsequent primary latching.

Figure 13:
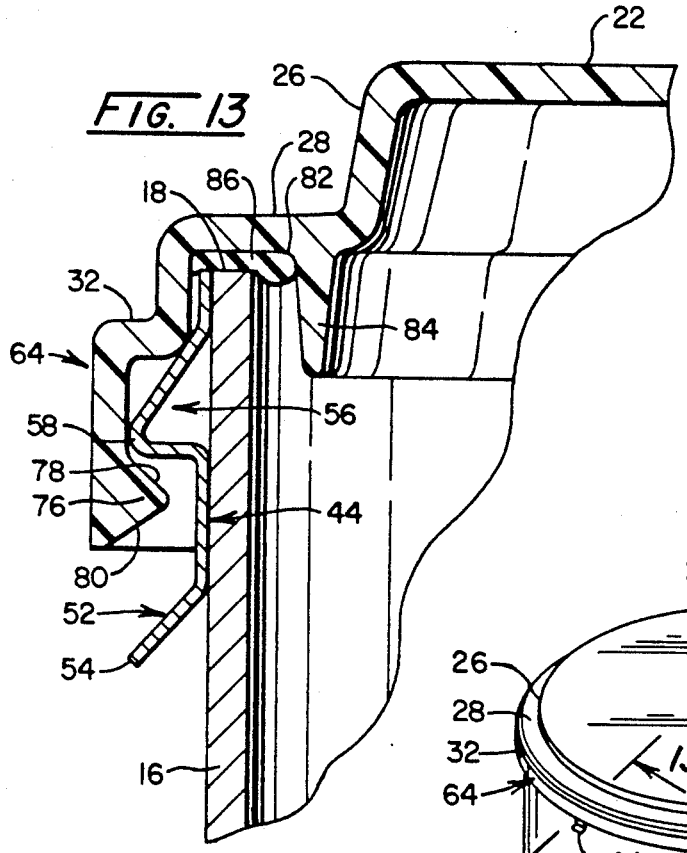
FIG. 13 is a partial sectional view taken through the plane 13—13 shown in FIG. 11.
Figure 11:
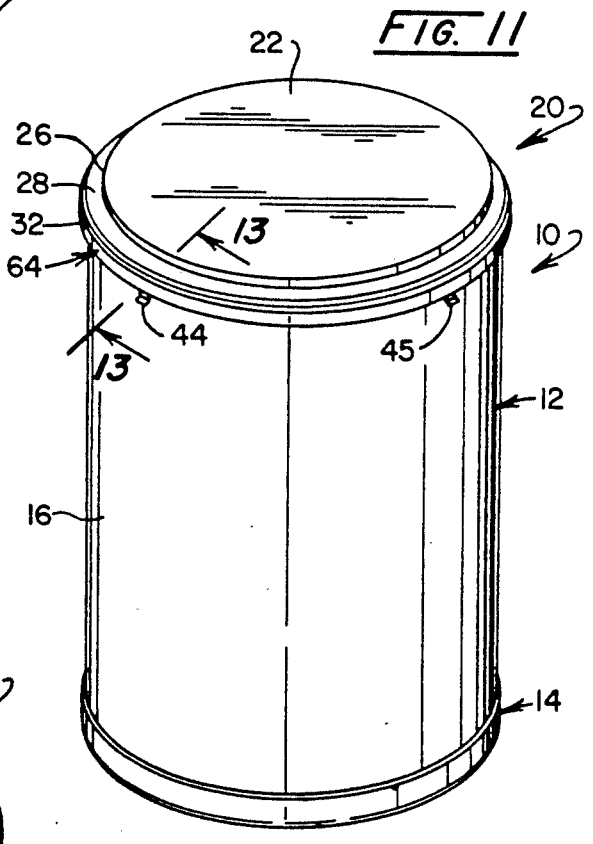
FIG. 11 is a perspective view of the container and lid assembly according to the invention as it appears in a reclosure mode.
Figure 12:
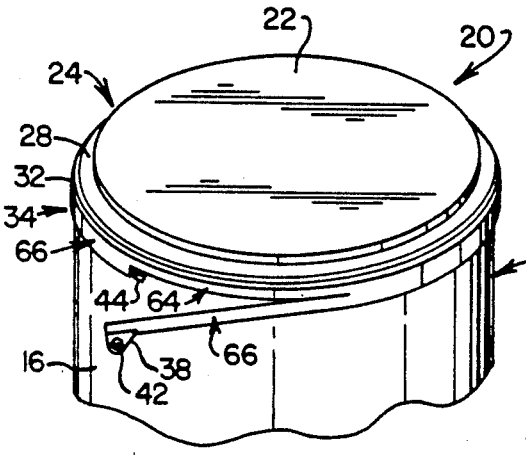
FIG. 12 is a partial sectional view of the container of FIG. 11 showing the commencement of removal of the primary latching feature thereof.

Referring to FIG. 11, the container assembly 10 is shown as it appears during a reclosure mode of utilization. In this mode, the initial opening of the container has taken place with removal of the primary latching features and the secondary latching components are used by the end user to periodically access the contents of container 12. FIG. 11 shows that the lower or primary detent component of fasteners 44 and 45 are exposed as are the similar components of the remaining fasteners 46 and 47 (not shown). Removal of the primary latching components, as noted above, is carried out by grasping the pull tab 38 and removing the lower portion 66 of skirt assembly 34 as represented as being undertaken in FIG. 12. Looking to FIG. 13, the resultant orientation of the secondary latching features are revealed. In the figure, it may be observed that the primary detent 52 is exposed and the secondary detent 56 is engaged. In the latter regard, rounded contact edge 58 is moveable into abuttable contact with continuous lid contact surface 78. The removal procedure involves pulling the lid 20 upwardly to cause outward flexure of upper skirt portion 64 and slideable movement off surface 58 across surface 78. For reclosure, the canted surface 80 engages contact surface 58 and again flexes the upper skirt portion 64 over the detent 56 to provide the latching engagement shown. Because of the required removal of lower skirt portion 66 to initially open the assemblage 10, the arrangement enjoys the attributes of being "tamper evident".

In addition to the sheet metal clip embodiment for fasteners as at 44 as described in detail in conjunction with FIGS. 3 and 4, other configurations may be employed. In this regard, FIG. 14 reveals a slightly altered structure for the fastener clip at 100. The fastener 100 includes a primary detent component 102 having a contact edge 104 which is structured identically with the corresponding detent 52 and edge 54 of fastener 44. Similarly, the secondary detent component of the fastener 100 is shown at 106 as being structured identically with that shown at 56, for example including a rounded contact edge 108. Fastener 100, however, has a general U-shaped configuration including inward component 110 which provides a channel which may be slideably positioned over the top edge 18 of container sidewall 16. The fastener 100 may be secured in position by any suitable arrangement such as adhesive cleats or the like. Additionally, where an adequate grip can be obtained with the channel formed within the fastener, then it may be press-fitted over the top edge 18.

Looking to FIG. 15, still another fastener arrangement is represented at 114 which is an integrally molded part adhesively affixed to the external surface of sidewall 16. In this regard, the primary detent components of the device are shown as two outwardly extending detents 116 and 118. Detents 116 and 118 are configured having lower engaging surfaces respectively at 120 and 122 which extend normall outwardly from the external surface of sidewall 16. In similar fashion, secondary detents 124 and 126 extend outwardly to provide a secondary latching component.

Figure 16:
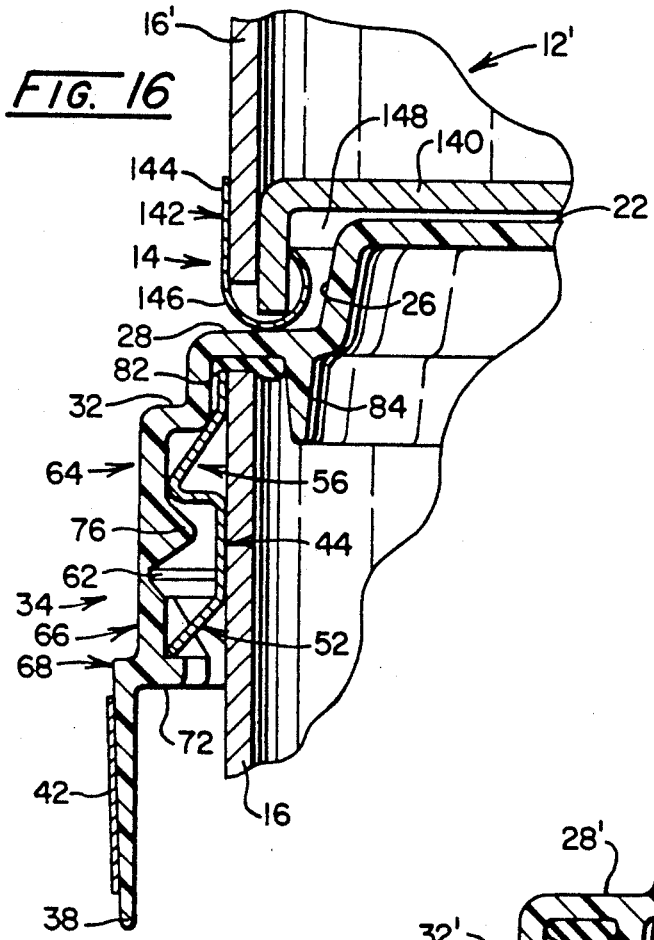
FIG. 16 is a partial sectional view of a lid and container structure shown in FIG. 1 and revealing an interlocking stacking feature incorporated therein.
Figure 17:
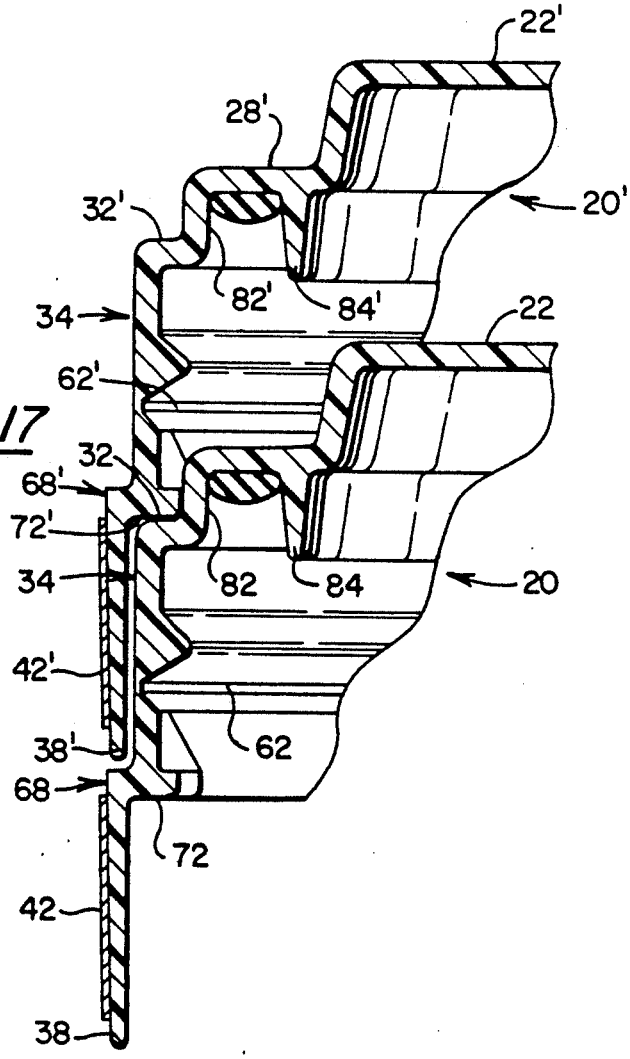
FIG. 17 is a partial sectional view of the lid structure of FIG. 1 showing a lid stacking feature of the assembly.

Looking to FIG. 16, the stacking feature for the container and lid assemblage is revealed. In the figure, an upwardly disposed container, represented in fragmentary form at 12' is shown having a fiber bottom portion 140. The bottom rim structure as revealed at 14' is shown having a typical chime configuration including a circular fastener or chime 142 having a flange component 144 attached to the external side of sidewall 16' and a crimping component of generally circular configuration at 146 which functions to hold together the end portion of bottom 140 and the bottom portion of side 16'. A cylindrical cavity as at 148 thus is developed such that the rounded bottom portion 146 of the chime structure 142 is aligned by ridge 26 of supporting lid 22 and is supported upon earlier-described container stacking surface 28.

Where the lids themselves are to be packaged and/or transported, then the lid stacking features of the lid component 20 of the invention are quite useful. Referring to FIG. 16, the stackable relationship of lids 20 with respect to a next adjacent lid 20' stacked thereon is revealed. It may be observed from the figure that stacking is achieved by seating the downwardly-disposed lid seating surface as at 72 upon the continuous upwardly-disposed lid seating surface 32 of a lid 20 supporting the former in stacking relationship. It may be recalled that the downwardly disposed lid stacking surface 72 represents the lower surface of primary latching lid 68. Even though the surface is of limited length, it is present in sufficient circumferential extent to provide the noted stacking function. Further, it may be observed that the pull tab 38 is integrally molded with skirt assembly 34 lower portion 66 but is configured so as to extend downwardly essentially from the outward surface thereof. Thus, the tabs as at 38 and 38' as shown in FIG. 17 do not interfere with the lid stacking procedure.

Since certain changes may be made in the above-described apparatus without departing from the scope of the invention herein involved, it is intended that all matter contained in the description thereof or shown in the accompanying drawings shall be interpreted as illustrative and not in a limiting sense.

I claim:

1. A closure assembly for a container of a variety having a sidewall with external and internal surfaces extending from a bottom rim to a top portion having a top edge, comprising:

discrete fastener means connected in predetermined spacedapart relationship with said sidewall, extending downwardly along the external surface thereof sustantially from said top edge, said fastener means including primary detent means and secondary detent means each extending outwardly from said external surface; and a molded lid for closure over said container including:

a lid top portion formed of resilient plastic material extensible across said container top portion to an outer periphery locatable adjacent said top edge, a skirt assembly integrally formed with said lid top portion and extending downwardly from said periphery to a lower edge locatable below said primary detent means, said skirt assembly including a parting groove extending thereabout to define upper and lower skirt portions and hand graspable means configured with said skirt lower portion for effecting the manual removal of said skirt lower portion from along said parting groove, primary latching ledge means formed within discete, spaced apart regions of said skirt assembly lower skirt portion in correspondence with said predetermined spaced apart relationship of said fastener means for non-releasing engagement with said primary detent means when said lid is rotationally oriented for engaing contact therewith, secondary latching detent means formed substantially continuously within said skirt assembly upper skirt portion for removable latching engagement with said fastener means secondary detent means in substantially all rotational orientations of said lid uopn said container, and a sealing channel formed within said lid top portion outer periphery for abutting, container closure engagement against said container top edge.

2. The closure assembly of claim 1 in which said primary latching ledge means is configured of lengthwise extent corresponding with a said spaced-apart region and includes limit stop means abuttable against an engaged said fastener means to restrict rotational movement of said lid.

3. The closure assembly of claim 1 in which:

said fastener means secondary detent means is configured having a rounded contact edge surface for effecting abutting contact with said lid secondary latching detent means; and said lid secondary latching detent means is configured having a downwardly sloping continuous contact surface for biasing abutment with said secondary detent means rounded contact edge to effect removable retention of said lid upon said container.

4. The closure assembly of claim 1 in which:

said lid primary latching ledge means is configured having an inwardly depending retainer surface extending substantially perpendicularly from the internally disposed surface of said skirt assembly; and said fastener means primary detent means is configured having a contact surface abuttably engageable with said retainer surface.

5. The closure assembly of claim 1 in which said lid top portion includes a centering ridge adjacent said outer periphery and a container stacking surface extending outwardly therefrom above said sealing channel for locating and supporting the bottom of another said container.

6. The closure assembly of claim 1 in which:

said lid primary latching ledge means extends normally inwardly from said skirt assembly lower edge to provide a downwardly disposed lid stacking surface;

said lid top portion includes an upwardly disposed lid seating surface at said periphery positioned outwardly of said sealing channel for receiving a said lid stacking surface of another lid for effecting an aligned, stacking relationship therewith.

7. The closure assembly of claim 6 in which said skirt assembly hand graspable means is a pull tab integrally formed with said lower skirt portion at the outwardly disposed surface thereof so as to provide for said aligned, stacking relationship.

8. The closure assembly of claim 1 in which said skirt assembly hand graspable means is a pull tab integrally formed with said lower skirt portion and located in predetermined relationship with respect to a said primary latching ledge means for facilitating said rotational orientation of said lid.

9. The closure assembly of claim 1 in which:

said lid includes a lid stacking surface extending inwardly from said skirt assembly lower edge; and said lid top portion includes a centering ridge adjacent said outer periphery, a container stacking surface extending outwardly therefrom above said sealing channel for locating and supporting the bottom of another said container, and an upwardly disposed lid seating surface positioned outwardly of said container stacking surface for receiving a said lid stacking surface of another lid in a stacking relationship.

10. The closure assembly of claim 1 in which said lid includes annular supporting rib means depending downwardly from the inner surface thereof and forming an inwardly disposed surface of said sealing channel for structurally stiffening said lid and facilitating lid centering over said container top edge.

11. The closure assembly of claim 1 in which each said discrete fastener means is formed as a sheet metal clip coupled to said container external surface by at least one cleat extending thereinto.

12. The closure assembly of claim 1 in which each said discrete fastener means is formed as a sheet metal clip having an internally disposed U-shaped channel mountable over said container top edge and extensible downwardly therefrom.

13. The closure assembly of claim 1 in which each said discrete fastener means is an integrally molded plastic clip adhesively affixed to said container external surface.

14. A closure assembly for a cellulosic container of a variety having a cylindrical sidewall with internal and external surfaces extending from a bottom rim to a top portion having a top edge, comprising:

a plurality of discrete fasteners connected to said container adjacent said top edge and located about said external surface in a predetermined spaced apart relationship, said fastener including a primary detent component and a secondary detent component spaced thereabove;

a molded lid orientable for closure over said container in a pre-fill mode, a filled mode and a reclosure mode, including:

a discoidal lid top portion formed of resilient plastic material extensible across said container top portion to an outer periphery locatable adjacent said top edge;

a skirt assembly integrally formed with said lid top portion and extending downwardly from said periphery to a lower edge locatable below said primary detent component, said skirt assembly including parting locus means for defining upper and lower skirt portions and hand graspable means configured with said skirt lower portion for facilitating the removal of said skirt lower portion;

a plurality of primary latching components formed within discrete, spaced apart regions of said skirt assembly lower skirt portion in correspondence with said predetermined spaced apart relationship of said fasteners, said primary latching components being non-engaged with said primary detent components of said fasteners when said lid is oriented for said pre-fill mode, being engaged with said primary detent components when said lid is oriented for said filled mode and disengageable therefrom substantially only by said removal of said lower skirt portion, to permit use of said lid in said reclosure mode; and secondary latching detent means formed substantially continuously within said skirt assembly upper skirt portion for removable latching engagement with said secondary detent component of said fasteners when said lid is oriented in said pre-fill, filled and reclosure modes.

15. The closure assembly of claim 14 in which said lid includes a sealing channel formed within said lid to portion outer periphery for abutting, container closure engagement against said container top edge.

16. The closure assembly of claim 14 in which each said primary latching component includes limit stop means abuttable against an engaged fastener to restrict rotational movement of said lid when providing said closure over said container.

17. The closure assembly of claim 14 in which:

said secondary detent component of said fastener is configured having a rounded contact edge surface for effecting abutting contact with said lid secondary latching detent means; and said secondary latching detent means is configured having a downwardly sloping continuous contact surface for biasing abuttment with said secondary detent component rounded contact edge to effect removable retention of said lid upon said container.

18. The closure assembly of claim 14 in which:

each said primary latching component is configured as an inwardly depending ledge having an inwardly depending retainer surface extending substantially perpendicularly from the internally disposed surface of said skirt assembly; and each said primary detent component is configured having a contact surface abuttably engageable with said retainer surface.

19. The closure assembly of claim 14 in which:

said lid includes a sealing channel formed within said lid to portion outer periphery for abutting, container closure engagement against said container top edge; and said lid top portion includes a centering ridge adjacent said outer periphery and a container stacking surface extending outwardly therefrom above said sealing channel for locating and supporting the bottom of another said container.

20. The closure assembly of claim 14 in which:

said lid includes a sealing channel formed within said lid to portion outer periphery for abutting, container closure engagement against said container to edge; and said lid primary latching component is configured as an inwardly depending ledge extending normally inwardly from said skirt assembly lower edge to provide a downwardly disposed lid stacking surface; and said lid top portion includes an upwardly disposed lid sealing surface at said periphery positioned outwardly of said sealing channel for receiving a said lid stacking surface of another lid for effecting an aligned, stacking relationship therewith.

21. The closure assembly of claim 20 in which said skirt assembly hand graspable means is a pull tab integrally formed with said lower skirt portion at the outwardly disposed surface thereof so as to provide for said aligned, stacking relationship.

22. The closure assembly of claim 14 in which said skirt assembly hand graspable means is a pull tab located in predetermined relationship with respect to a said primary latching component for facilitating said lid orientation for said pre-fill mode and said filled mode for closure.

23. The closure assembly of claim 21 in which said pull tab includes an adhesively attached roughened surface to provide an enhanced frictional grasp.

24. The closure assembly of claim 14 in which:

said lid includes a sealing channel formed within said lid to portion outer periphery for abutting, container closure engagement against said container top edge;

said lid includes a lid stacking surface extending inwardly from said skirt assembly lower edge; and said lid top portion includes a centering ridge adjacent said outer periphery, a container stacking surface extending outwardly therefrom above said sealing channel for locating and supporting the bottom of another said container, and an upwardly disposed lid seating surface positioned outwardly of said container stacking surface for receiving a said lid stacking surface of another lid in a stacking relationship.

25. A lid for multi-mode closure over a cellulosic container of a variety having a sidewall with internal and external surfaces extending from a bottom rim to a top portion having a top edge and wherein a plurality of discrete fasteners are connected to the container adjacent said top edge and located about said external surface in a predetermined, spaced apart relationship and including a primary retaining component and a secondary detent component spaced above said primary retaining component, the lid comprising:

a discoidal lid top portion formed of resilient plastic material and extensible across said container top portion to an outer periphery locatable adjacent said top edge;

a skirt assembly integrally formed with said lid top portion and extending downwardly therefrom to a lower edge, said skirt assembly including a parting groove extending thereabout to define upper and lower skirt portions and hand graspable means configured with said skirt lower portion for providing for the removal of said skirt lower portion;

a plurality of primary latching ledges formed within discrete, spaced apart regions of said skirt assembly lower skirt portion in correspondence with said predetermined spaced apart relationship of said fastener and depending inwardly from said skirt assembly lower edge, said primary latching ledges being non-engaged with said primary retaining component of each said fastener when said lid is oriented for a pre-fill said mode, being engaged with said primary retaining component of said fasteners when said lid is oriented for a filled said mode and disengageable therefrom substantially only by said removal of said lower skirt portion;

secondary latching detent means formed substantially continuously within said skirt assembly upper skirt portion for removable latching engagement with said secondary detent component of said fastener when said lid is oriented in said pre-fill, and filled modes and in a reclosure said mode occurring subsequent to said removal of said lower skirt portion.

26. The lid of claim 25 in which said lid includes a sealing channel formed within said lid top portion outer periphery for abutting, container closure engagement against said container top edge.

27. The lid of claim 26 in which:

each said lid primary latching ledge extends normally inwardly from said skirt assembly lower edge to provide a downwardly disposed lid stacking surface; and said lid top portion includes an upwardly disposed lid seating surface at said periphery positioned outwardly of said sealing channel for receiving a said lid stacking surface of another lid for effecting an aligned, stacking relationship therewith.

28. The lid of claim 27 in which said skirt assembly hand graspable means is a pull tab integrally formed with said lower skirt portion at the outwardly disposed surface thereof so as to provide for said aligned, stacking relationship.

29. The lid of claim 25 in which said skirt assembly hand graspable means is a pull tab integrally formed with said lower skirt portion and located in substantial alignment with a said primary latching ledge for facilitating said lid orientation for said pre-fill mode and said filled mode.

30. The lid of claim 28 in which said pull tab includes an adhesively attached roughened surface to provide an enhanced frictional grasp.

31. The lid of claim 26 in which said top portion includes a centering ridge adjacent said outer periphery and a container stacking surface extending outwardly therefrom above said sealing channel for locating and supporting the bottom of another said container.

32. The lid of claim 26 in which:

said lid includes a lid stacking surface extending inwardly from said skirt assembly lower edge; and said lid top portion includes a centering ridge adjacent said outer periphery, a container stacking surface extending outwardly therefrom above said sealing channel for locating and supporting the bottom of another said container, and an upwardly disposed lid seating surface positioned outwardly of said container stacking surface for receiving a said lid stacking surface of another lid in a stacking relationship.

33. The lid of claim 25 in which each said primary latching edge includes limit stop means abuttable against an engaged said fastener to restrict rotational movement of said lid when providing said closure over said container.

* * * * *